US006571817B1

(12) United States Patent
Bohan, Jr.

(10) Patent No.: US 6,571,817 B1
(45) Date of Patent: Jun. 3, 2003

(54) PRESSURE PROVING GAS VALVE

(75) Inventor: John E. Bohan, Jr., Edina, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/514,117

(22) Filed: Feb. 28, 2000

(51) Int. Cl.[7] ..... F23N 5/18; F23N 5/24; G05D 11/13

(52) U.S. Cl. ..... 137/88; 137/4; 137/6; 137/9; 137/87.01; 137/101.19; 137/487.5; 431/12; 431/19; 431/75; 431/89

(58) Field of Search ..... 137/65, 66, 6, 137/9, 87.01, 100, 101.19, 486, 487.5, 88, 4; 431/12, 18, 19, 75, 77, 78, 89, 90; 126/116 A

(56) References Cited

U.S. PATENT DOCUMENTS

| | | | | | |
|---|---|---|---|---|---|
| 1,942,793 | A | * | 1/1934 | Bailey | 137/101.19 |
| 2,352,584 | A | * | 6/1944 | Ziebolz et al. | 137/101.19 |
| 2,394,297 | A | * | 2/1946 | Fayles | 137/101.19 |
| 2,420,415 | A | * | 5/1947 | Bristol | 137/101.19 |
| 2,797,746 | A | * | 7/1957 | Bourek et al. | 137/101.19 |
| 3,118,494 | A | * | 1/1964 | Yost | 137/66 |
| 3,666,173 | A | * | 5/1972 | Ray | 137/66 |
| 3,762,428 | A | * | 10/1973 | Beck et al. | 137/101.19 |
| 3,935,851 | A | * | 2/1976 | Wright et al. | 137/101.19 |
| 4,048,964 | A | * | 9/1977 | Kissel | 137/101.19 |
| 4,050,878 | A | * | 9/1977 | Priegel | 137/101.19 |
| 4,125,093 | A | * | 11/1978 | Platzer, Jr. | 137/101.19 |
| 4,277,254 | A | * | 7/1981 | Hanson | 137/101.19 |
| 4,295,129 | A | * | 10/1981 | Cade | 126/388 |
| 4,345,612 | A | * | 8/1982 | Koni et al. | 137/101.19 |
| 4,585,161 | A | * | 4/1986 | Kusama et al. | 137/101.19 |
| 4,696,639 | A | * | 9/1987 | Bohan, Jr. | 137/66 |
| 4,838,295 | A | * | 6/1989 | Smith et al. | 137/9 |
| 4,842,510 | A | * | 6/1989 | Grunden et al. | 431/19 |
| 4,872,828 | A | * | 10/1989 | Mierzwinski et al. | 431/16 |
| 4,955,806 | A | * | 9/1990 | Grunden et al. | 431/78 |
| 5,401,162 | A | | 3/1995 | Bonne | 431/12 |
| 5,628,303 | A | * | 5/1997 | Ahmady et al. | 431/19 |
| 5,634,786 | A | | 6/1997 | Tillander | 431/90 |
| 5,971,745 | A | * | 10/1999 | Bassett et al. | 431/78 |
| 5,993,194 | A | * | 11/1999 | Lemelson et al. | 431/78 |
| 5,993,195 | A | * | 11/1999 | Thompson | 431/19 |

FOREIGN PATENT DOCUMENTS

| | | | | |
|---|---|---|---|---|
| DE | 19847448 A | | 4/1999 | |
| EP | 0315288 A | | 5/1989 | |
| EP | 0697563 A | | 2/1996 | |
| JP | 03067917 A | | 3/1991 | |
| JP | 5-118539 A | * | 5/1993 | 431/19 |
| JP | 05157231 A | | 6/1993 | |

* cited by examiner

*Primary Examiner*—George L. Walton

(57) ABSTRACT

A pressure proving gas valve insures safe and efficient operation of a fuel-burning appliance by monitoring combustion air pressure and appropriately controlling the valve based upon this air pressure. An air pressure sensor is incorporated into a pressure proving valve housing itself thus providing integrated solution for the control of the combustion process. Consequently, when heat is called for, no fuel is provided to the combustion chamber unless appropriate combustion air pressure is sensed. Further, by monitoring the actual air pressure, additional control capability is provided. That is, a variable speed blower associated with the combustion apparatus can be controlled to provide very precise fuel to air mixtures.

16 Claims, 3 Drawing Sheets

PRESSURE PROVING GAS VALVE

BACKGROUND OF THE INVENTION

The present invention relates to gas valves used in fuel burning appliances. More specifically, the present invention relates to a gas valve which safely operates by insuring that combustion air is present before gas is provided to the combustion chamber.

In fuel burning heating systems, gas valves are typically used to control the flow of fuel into a combustion chamber. Several different control methods have been used for operating this gas valve. Generally speaking, the gas valve is operationally attached to a thermostat. When the thermostat calls for heat, the gas valve is then actuated, providing gas to the combustion chamber. Other components of the heating system (blowers, vents, etc.) are also operated to cause the heating of air, which is thus provided at a furnace output.

As can be appreciated, it is essential that combustion air be present in order to allow burning of the combustion fuel. If combustion air is not present, and the gas valve is opened, a potentially dangerous situation is created.

One method for insuring that combustion air is present in the combustion chamber includes the use of a pressure switch which is operationally coupled to the combustion chamber. More specifically, a pressure switch is attached such that its input is connected to the combustion chamber. Thus, when the pressure is above a predetermined level, this pressure switch is closed. This switch can then be used as a safety system for the furnace. More specifically, the furnace will not be allowed to operate unless this pressure switch is closed.

Unfortunately, typical pressure switches utilized in this fashion are large and cumbersome. These pressure switches are typically a pancake type pressure switch which is typically configured in a disk shaped format, about three inches in diameter. These pressure switches take up space and are not easily integrated into heating systems. Also, this switch provides only an on/off type output. Thus, the switches do not provide any additional information which may prove useful in the operation of the furnace. Additionally, the pressure level at which the switch closes cannot be adjusted after the switch has been installed. Consequently, this type of pressure sensor has many drawbacks and is not the most beneficial device to use.

SUMMARY OF THE INVENTION

The present invention provides an integrated solution which safely and efficiently operates a gas valve for a combustion furnace. In addition to the typical functions of a gas valve (i.e., control of fuel to a combustion chamber), the valve includes an integrated combustion air sensor for monitoring combustion air. The output from the sensor is provided to a controller which will not allow the valve and/or furnace to operate when combustion air is not present.

All components of the pressure proving gas valve are contained in a single housing. These components include the valve element, the controller, and combustion air sensor, and all necessary inlet and outlet ports. More specifically, the housing includes a fuel inlet port, a fuel outlet port and an air flow inlet port. The fuel inlet port and the fuel outlet port are on opposite sides of the valve element, thus controlling the flow of combustion fuel therethrough. Similarly, the airflow inlet port is in communication with the combustion air sensor, to allow its efficient operation. In addition to these inlets, all necessary electrical connections are provided through openings in the housing. These electrical connections include those necessary to communicate with the controller. Further, connections to an external thermostat are provided, thus allowing the basic function of the valve.

By including the combustion air sensor within the valve housing itself, additional functionality and wiring simplicity is also provided. Typically, a fan or blower of some type is associated with the furnace. This fan could thus be connected to the controller to regulate airflow as necessary. Thus, in addition to sensing the presence of airflow, the airflow itself could be specifically controlled. Specific air to gas ratios can then be achieved in the combustion process. Without the airflow sensor within the gas valve, this overall functionality is difficult and costly to achieve.

It is an object of the present invention to provide additional safety functions to a gas valve by insuring airflow is present. Thus, gas will not be provided to the combustion chamber without airflow also being present, thus avoiding potentially dangerous situations.

It is an additional object of the present invention to provide an integrated solution and additional functionality to the gas valve by coordinating multiple operations. As is well understood, a valve can be controlled to efficiently run the gas-burning portion of the furnace itself. However, by being able to monitor and control airflow through the furnace, in addition to gas flow, multiple operating conditions can be achieved. For example, very specific fuel air ratios can be maintained in the combustion chamber for whatever purpose is necessary.

The present invention further provides an additional safety feature by sensing and indicating that the combustion path is blocked or someway restricted. For example, should the exhaust pathway be blocked somehow, the valve of the present invention would recognize that and shut off.

BRIEF DESCRIPTION OF THE DRAWINGS

Further objects and advantages of the present invention can be seen by reviewing the following detailed description in conjunction with the drawings in which.

DETAILED DESCRIPTION OF PREFERRED EMBODIMENTS

Figure 1:
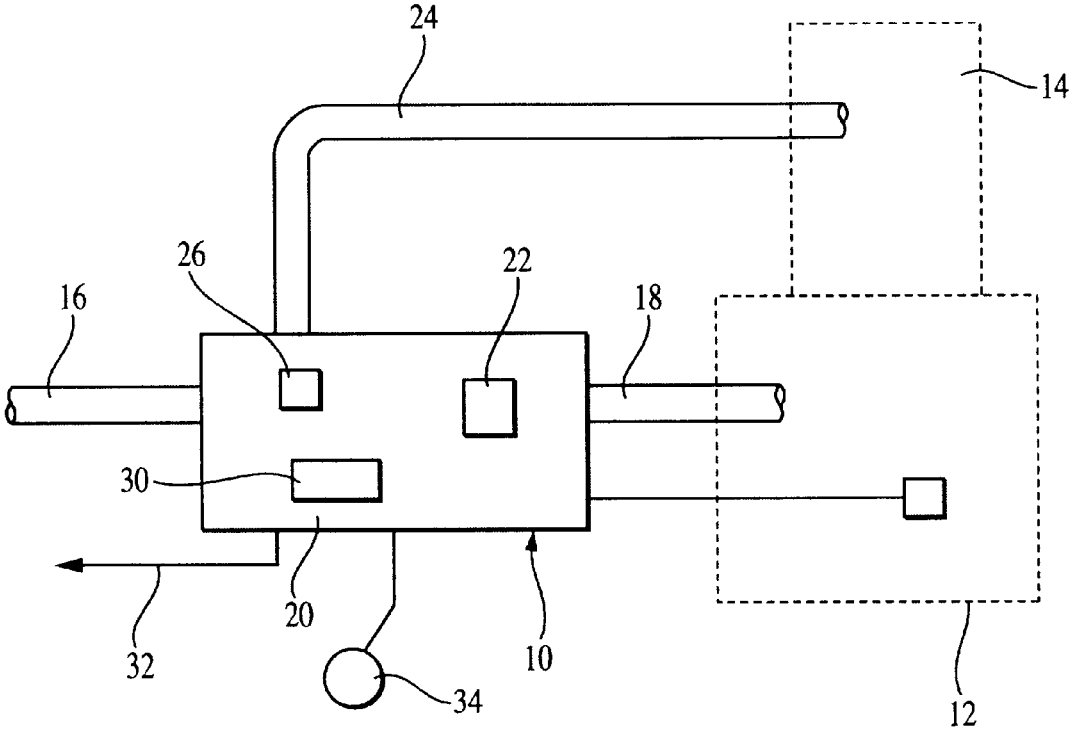
FIG. 1 is a schematic drawing of one version of the present invention.

Referring now to FIG. 1, there is shown a schematic drawing of the pressure proving valve 10 of the present invention. As expected, the pressure proving valve 10 is located in close proximity to a combustion chamber 12 which has an exit air chamber 14 located down stream from combustion chamber 12. Associated with pressure proving valve 10 is a gas inlet 16 and a gas outlet 18. Within the housing 20 of pressure proving gas valve 10, there exists a valve assembly 22 which performs a typical gas valve function including regulating the flow of gas and appropriately turning it on or off. This also may include the regulation of a variable level of gas flow, as is appropriate for the heating system.

The pressure proving valve 10 further has an airflow connection 24 attached thereto. In the preferred embodiment, this is a pressure sensor inlet. As the flow of air can be determined by measuring pressure at various points, a pressure sensor is appropriately used for providing combustion air information to other components. Alternatively, a mass airflow sensor or a microbridge airflow sensor may be used. Cooperating with airflow connection 24 is a combustion air sensor or transducer 26 (of one of the preceding types of sensors) which is located within housing 20. Also located within housing 20 is a controller 30 which is in operational connection with the sensors and receives information and coordinates the operation of the gas valve. This controller can typically be a microcontroller or microprocessor of some type. In order to provide power, a power connection 32 is provided to pressure proving valve 10. Furthermore, a thermostat 34 is typically associated with the valve and provides control signals thereto. As is well known, the thermostat generally provides a signal calling for heat which subsequently causes the gas valve to open, thus creating appropriate conditions for combustion to occur within the combustion chamber.

Figure 2:
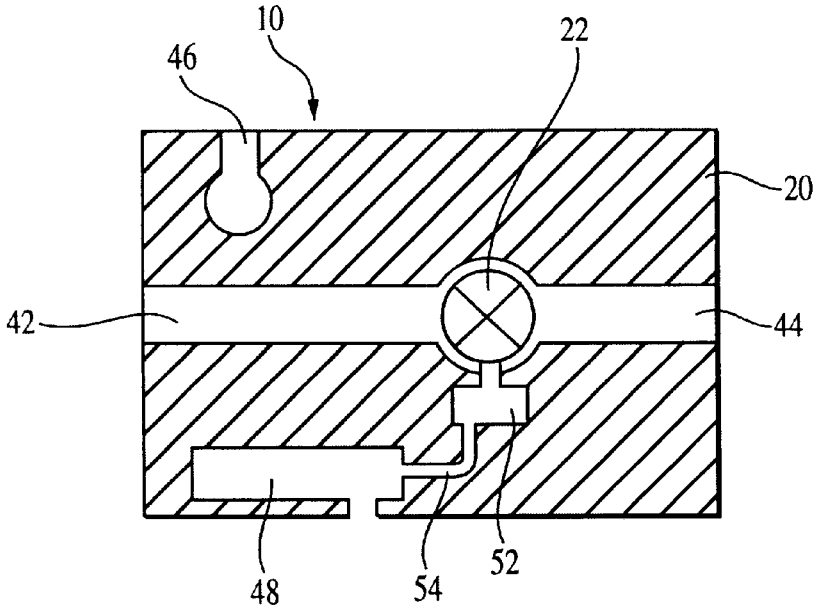
FIG. 2 illustrates one embodiment of gas valve itself.

Referring now to FIG. 2, there is shown a cross sectional view of the pressure proving valve 10 of the present invention. As previously mentioned, pressure proving valve 10 is primarily constructed of a single housing 20 which accommodates many other parts. Housing 20 has an inlet channel 42 and an outlet channel 44 situated on opposite sides of the valve. Shown here in schematic format again is valve 22 which separates inlet channel 42 from outlet channel 44.

Also located in housing 20 is airflow sensor inlet 46. Airflow sensor inlet 46 is configured to have air flow sensor tube 24 attached thereto and also to house an appropriate combustion air sensor. As previously mentioned, one method of sensing airflow is simply to provide a pressure sensor which is capable of measuring pressures at various points. From these measurements, several different values and characteristics can be calculated.

Although not shown in FIG. 2, appropriate connection channels are provided within housing 20 so that electrical signals can be communicated from the air flow sensor to other devices.

Also situated within housing 20 is a controller housing 48 which will house the controller and all necessary connections thereto. As previously mentioned, controller 30 provides many control and operational functions for the present invention. Consequently, various connections are necessary including thermostat connections, power connections, etc. Also shown within housing 20, and associated with valve 22, is a valve mechanism housing 52 which houses and maintains all controls for valve 22. A connection channel 54 is provided to allow connection between controller 30 and valve 22.

Figure 3:
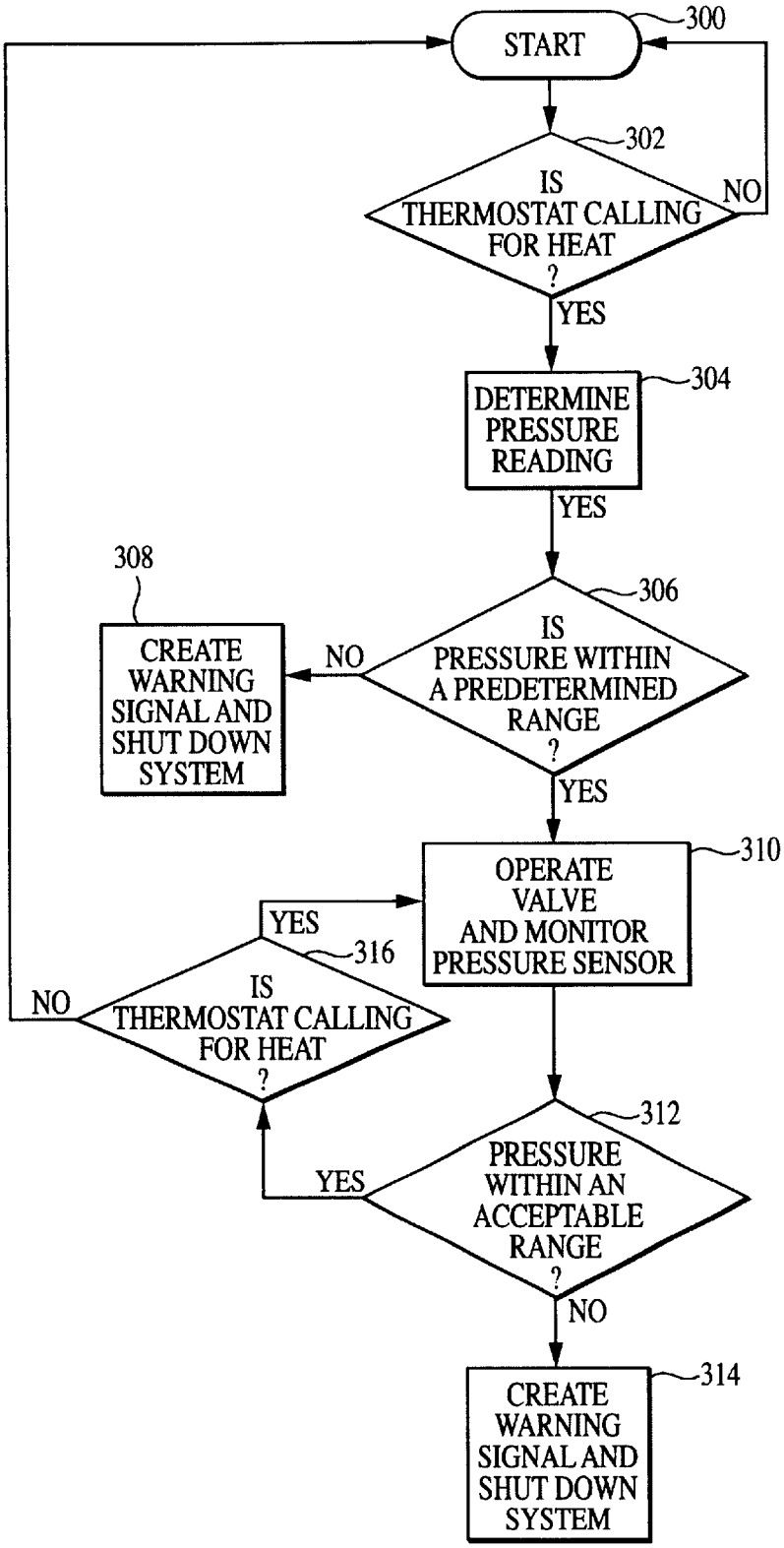
FIG. 3 is a flow chart illustrating one method of operation for the present invention.

Referring now to FIG. 3, there is shown a flow chart illustrating the control methodology of the pressure proving gas valve. In summary, the pressure proving valve allows the ability for the valve to determine whether appropriate conditions exist within the combustion chamber prior to providing combustion fuel. Thus, in situations where the combustion air path is blocked, gas is not allowed to dangerously accumulate within that area. As can be expected, there is typically a set up and system configuration process which must precede any functional operation. This set up and initiation typically involves verifying the presence and operation of all sensors, as well as verifying the operational status of the valve. The process may be used by controller 30.

Starting at step 300, the control process begins. Next, in step 302, the system determines whether the thermostat has called for heat. If not, the valve need do nothing, and it simply waits until an appropriate call for heat is made by the thermostat. If the call for heat is made, the system then moves on to step 304 wherein it determines if air flow is present through the combustion chamber. As previously described, a heating system typically includes an inducer mechanism which draws air into the combustion chamber which can then provide appropriate conditions for the burning of heating fuel. In most situations, this heating fuel is natural gas, however, other fuels may be used. By measuring for air flow at this point in time, the system can then determine the necessary combustion air is being provided. Next, at step 306 the system determines if air flow is at an appropriate level. As can be expected, the air flow must be above some minimum level in order to provide enough air for combustion to occur. At the same time, too much air flow can pass through the combustion chamber which also provides conditions which are not conducive to the efficient burning of fuel. If the air flow is not within this predetermined range, the system moves to step 308 wherein a warning signal is created and the heating system is shut down. Most importantly, no fuel is provided to the combustion chamber at this point. This is done by simply turning off the valve portion of the pressure proving valve and not allowing any fuel to pass from inlet channel 42 to outlet channel 44.

Alternatively, if the pressure is within the predetermined range, the system moves to step. 310 wherein the valve is operated according to predetermined criteria. This criteria typically includes responding to signals provided by the thermostat, and appropriately providing fuel to the combustion chamber for its heating operation. Additionally, air flow is continually monitored during this step to insure an operational flow of combustion air through the system. This insures safe and accurate operation of the heating system, and avoids the creation of dangerous situations. In step 312, the system analyzes this air flow reading, or pressure signal, and determines whether the air flow is within the necessary range. If the air flow is within the necessary range, the system continues to operate. This is shown in FIG. 3 as a perpetual loop from steps 312 back through steps 316, 310 and 312. Alternatively, should the air flow fall outside the desired range, the system is again shut down and a warning signal is created. This is shown in step 314. Once step 314 is reached, no further action is taken by the system until the dangerous condition is attended to. Typically, this involves operator interaction, but may include other software test functions which could be carried out by other systems.

Figure 4:
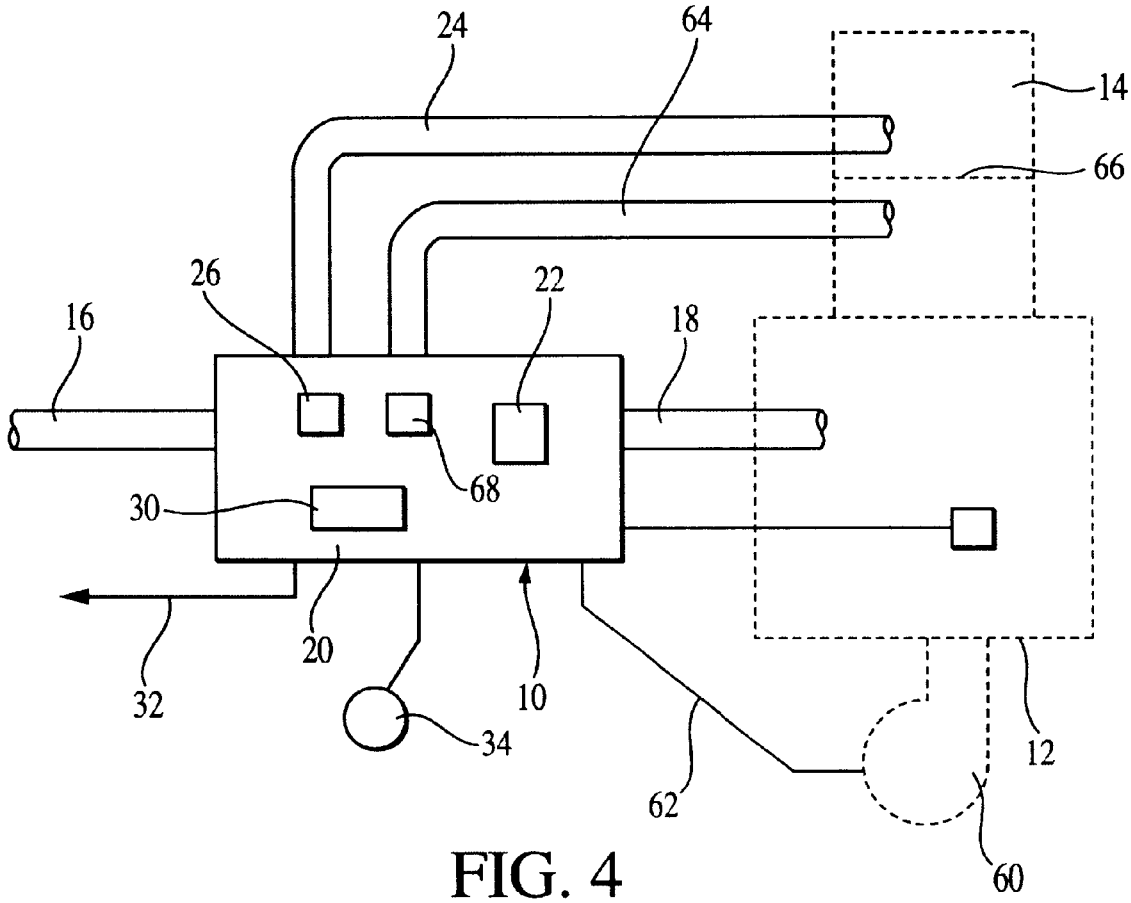
FIG. 4 illustrates a schematic diagram of an alternative embodiment of the present invention.

Referring now to FIG. 4, there is shown an alternative embodiment of the present invention in which additional features are added. These features are made possible by the inclusion of the pressure proving characteristic previously discussed. As can be seen, the system shown in FIG. 4 is very similar to that shown in FIG. 1, however, a variable speed blower 60 has now been added. Additionally, a blower connection 62 is provided which connects controller 30 to variable speed blower 60. Another variation is the addition of a second airflow connection 64 and a second combustion air sensor 68. When installed, the first airflow connection 24 is positioned on one side of an orifice 66 while second airflow connection 64 is positioned on a second side of orifice 66. In this case, the two airflow sensors 26, 68 are pressure sensors. By knowing the pressure on either side of this orifice, the amount of air flow is easily calculated. Once this air flow is determined, many different features are enabled in the system. As previously mentioned, controller 30 provides overall control and operational features to pressure proving valve 10. Allowing controller 30 to calculate the actual air flow, and by having an output connected to variable speed blower 60, very precise control of the combustion operations is achieved. That is, variable speed blower 60 could be controlled such that very precise fuel to air mixtures are achieved. The process of choosing a particular design fuel to air ratio is well known in the art.

As can be appreciated, there are several modifications that could be made which would provide similar functionality. For example, while FIG. 4 shows a forced draft system, an induced draft system could be used. An induced draft system can be easily achieved by simply moving the variable speed blower 60 to the down stream side of the combustion chamber. Also, as outlined in relation to the system shown in FIG. 1, a single sensor could be used to determine air flow.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A pressure proving valve for use in a fuel burning furnace, comprising:

a single housing integratable with a fuel burning heating system, the single housing comprising:

a controller section for enclosing a controller and connections thereto;

a valve mechanism section for enclosing a valve and associated valve controls;

a connection channel to permit connection and associated controls between the controller and the valve;

a fuel inlet for receiving combustion fuel;

a fuel outlet for connecting combustion fuel to a combustion chamber; and a combustion air inlet;

a valve located within the valve mechanism section for controlling the flow of fuel from the fuel inlet to the fuel outlet in a predetermined manner;

a transducer mounted within the single housing and in communication with the combustion air inlet, the transducer further having an output for providing a signal indicative of the presence of combustion air within the combustion chamber, wherein the transducer is a pressure transducer for sensing the pressure of combustion air within the combustion chamber;

a controller mounted within the controller section, the controller comprising:

a pressure input attached to the transducer output;

an output attached to the valve for providing signals to the controller to control the operation of the valve to maintain an air to fuel ratio within the combustion chamber that is within a predetermined parameter; and wherein when the air to fuel ratio can no longer be maintained within the predetermined parameters, the signal communicates with the valve to stop fuel flow, thereby fuel is not provided to the combustion chamber until a predetermined amount of combustion air is present inside the combustion chamber wherein the valve is re-opened.

2. The valve of claim 1 wherein the controller further has an input terminal for receiving signals from a thermostat, wherein the controller further provides signals to control the valve in a predetermined manner in response to both the thermostat signals and the pressure signals.

3. The valve of claim 1 wherein the transducer further comprises an airflow sensor for sensing the flow of combustion air at the combustion air inlet.

4. The valve of claim 3 wherein the airflow sensor is a microbridge airflow sensor.

5. The valve of claim 3 wherein the airflow sensor is a mass flow sensor.

6. The valve of claim 1 wherein the controller further controls the valve to provide variable amounts of fuel to the combustion chamber depending upon the amount of combustion air sensed by the transducer.

7. The valve of claim 1 wherein the controller includes a blower output for controlling the operation of a related variable speed blower at least when the air to fuel ratio approaches the predetermined parameters.

8. The valve of claim 7 wherein the amount of air provided by the variable speed blower is proportional to the amount of fuel in order to achieve a predetermined fuel to air ratio.

9. An integral pressure proving gas valve for use in a heating system, the pressure proving gas valve comprising a single housing having:

a valve system permitting and controlling the flow of gas between a valve input and a valve output;

a gas inlet channel in communication with the valve input;

a gas outlet channel in communication with the valve output;

a sensor for determining the presence of combustion airflow within a combustion chamber, wherein the sensor is a pressure transducer for sensing the pressure of combustion air within the combustion chamber; and a controller having an input in communication with the sensor and having an output in communication with the valve system such that the controller is capable of adjusting the valve system to continuously maintain an air to fuel ratio within the combustion chamber that is within a predetermined parameter regardless of amount of air flow, wherein when the air to fuel ratio cannot be maintained within the predetermined parameters by the controller, the controller will signal the valve to stop gas flow and not allow gas to flow from the valve input until sufficient combustion air pressure is present in the combustion chamber, wherein the valve is re-opened.

10. The integral valve of claim 9 wherein the sensor is in communication with the combustion air at a combustion air inlet, thus allowing the sensor to determine if the combustion airflow is present.

11. The integral valve of claim 10 wherein the sensor is an airflow sensor for sensing the flow of combustion air at the combustion air inlet.

12. The integral valve of claim 11 wherein the airflow sensor is a microbridge airflow sensor.

13. The integral valve of claim 11 wherein the airflow sensor is a mass flow sensor.

14. The integral valve of claim 9 wherein the controller further has a thermostat input for receiving signals from a thermostat, wherein the controller further provides signals to control the valve system in a predetermined manner in response to both the thermostat signals and the pressure signals.

15. The integral valve of claim 9 wherein the controller further controls the valve system to provide variable amounts of gas to the combustion chamber depending upon the amount of airflow sensed by the sensor.

16. A method of controlling the flow of fuel into a combustion chamber in order to maintain an air to fuel ratio that is within predetermined parameters, comprising:

providing a single housing integratable with a fuel burning heating system, the single housing comprising:

a controller section for enclosing a controller and connections thereto;

a valve system section for enclosing a valve system and associated controls;

a connection channel to permit connection between the controller and the valve system;

a fuel inlet for receiving combustion fuel;

a fuel outlet for connecting combustion fuel to a combustion chamber; and a combustion air inlet;

a valve system located within the valve system section for controlling the flow of fuel from the fuel inlet to the fuel outlet in a predetermined manner;

a transducer mounted within the single housing and in communication with the combustion air inlet; and a controller mounted within the controller section, the controller comprising a pressure input attached to the transducer output, an output attached to the valve for providing signals to the controller to control the operation of the valve;

receiving a signal from an integral combustion air sensor indicative of the amount of combustion air flowing through the combustion chamber;

determining if the air pressure is outside of a predetermined parameters; and controlling the valve system to maintain the predetermined fuel to air ratio such that fuel and air are provided to the combustion chamber as necessary, wherein when the air to fuel ratio can no longer be maintained within the predetermined parameters, the controller signals the valve to stop gas flow such that fuel is not provided to the combustion chamber until a predetermined amount of combustion air is present inside the combustion chamber, wherein the valve is re-opened.

* * * * *